US005319423A

United States Patent [19]

Takeda et al.

[11] Patent Number: 5,319,423

[45] Date of Patent: Jun. 7, 1994

[54] IMAGE FORMING SYSTEM INCLUDING ROTATABLE IMAGE BEARING MEMBER AND ROTATABLE TRANSFER SHEET BEARING MEMBER ROTATABLY DRIVEN BY COMMON DRIVE SOURCE

[75] Inventors: Atsushi Takeda, Kawasaki; Koji Amemiya, Tokyo, both of Japan

[73] Assignee: Canon Kabushiki Kaisha, Tokyo, Japan

[21] Appl. No.: 925,072

[22] Filed: Aug. 5, 1992

[30] Foreign Application Priority Data

Aug. 6, 1991 [JP] Japan ..... 3-219329

[51] Int. Cl.[5] ..... G03G 15/14

[52] U.S. Cl. ..... 355/271; 355/326 R

[58] Field of Search ..... 355/326, 327, 328, 271, 355/208, 210, 273; 346/160

[56] References Cited

U.S. PATENT DOCUMENTS

| | | | |
|---|---|---|---|
| 3,813,161 | 5/1974 | Curtis | 355/75 |
| 3,848,204 | 11/1974 | Draugelis et al. | 355/277 |
| 3,869,203 | 3/1975 | Lehmann | 355/327 |
| 3,877,416 | 4/1975 | Donohue et al. | 355/273 |
| 3,960,444 | 6/1976 | Gundlach et al. | 355/327 X |
| 4,027,962 | 6/1977 | Mailloux | 355/327 X |
| 4,053,216 | 10/1977 | Mailloux | 355/326 X |
| 4,053,217 | 10/1977 | Mailloux | 355/327 |
| 4,063,810 | 12/1977 | Mailloux | 355/327 |
| 4,068,939 | 1/1978 | Mailloux | 355/326 |
| 4,088,481 | 8/1978 | Ayash | 430/33 |
| 5,162,854 | 11/1992 | Hilbert et al. | 355/326 X |

FOREIGN PATENT DOCUMENTS

| | | |
|---|---|---|
| 49-113635 | 10/1974 | Japan . |
| 61-83557 | 4/1986 | Japan . |

*Primary Examiner*—A. T. Grimley
*Assistant Examiner*—Sandra L. Brase
*Attorney, Agent, or Firm*—Fitzpatrick, Cella, Harper & Scinto

[57] ABSTRACT

An image forming system including a rotatable image bearing member, a rotatable transfer sheet bearing member for bearing a transfer sheet, and a common drive source for rotatably driving the image bearing member and the transfer sheet bearing member. An image is transferred from the image bearing member onto the transfer sheet born by the transfer sheet bearing member. The image bearing member and the transfer sheet bearing member are rotated at the same angular velocity.

19 Claims, 9 Drawing Sheets

IMAGE FORMING SYSTEM INCLUDING ROTATABLE IMAGE BEARING MEMBER AND ROTATABLE TRANSFER SHEET BEARING MEMBER ROTATABLY DRIVEN BY COMMON DRIVE SOURCE

BACKGROUND OF THE INVENTION

1. Field of the Invention

The present invention relates to an image forming system for transferring an image formed on an image bearing member onto a transfer sheet carried by a transfer sheet bearing member, and more particularly it relates to an image forming system suitable to be used with color electrophotographic equipment of electrophotographic type of electrostatic type.

2. Related Background Art

In the past, in color electrophotographic equipment, an electrophotographic photosensitive drum acting as an image bearing member is rotatably supported and a toner forming means forming a toner image on the drum is arranged around the drum.

More particularly, the photosensitive drum is uniformly charged by a primary charger and a light image corresponding to image information is illuminated on the photosensitive drum by an exposure means comprising a laser scanner and the like, thus forming an electrostatic latent image on the photosensitive drum. Then, the electrostatic latent image is visualized as a toner image, for example, by a shiftable developing means.

The shiftable developing means comprises four developing devices containing magenta color developer, cyan color developer, yellow color developer and black color developer, respectively, and a guide for holding these four developing devices and shiftable in a horizontal direction. The shiftable developing means permits movement of a desired developing device to a position facing an outer surface of the photosensitive drum.

The various color toner images formed on the photosensitive drum are successively transferred and superimposed on a transfer sheet carried and conveyed by a rotating transfer drum acting as a transfer sheet bearing member.

The photosensitive drum is supported on a rotary shaft so that it is rotated by driving the rotary shaft by a driven motor. The photosensitive drum is provided at its axial end with a flange having a gear which is meshed with a gear integrally formed with the transfer drum in the vicinity of a surface of the latter. Thus, when the photosensitive drum is rotated, the transfer drum is also rotatingly driven.

When such a driving system is used, in order to prevent a so-called "discrepancy in color" in the superimposing transfer of the toner images, techniques wherein an outer diameter of the transfer drum is greater than that of the photosensitive drum by an integral number times have been proposed, as disclosed in the Japanese Patent Laid-Open Nos. 49-113635 and 61-83557. Further, a technique wherein the photosensitive drum and the transfer drum are driven by independent driven motors has also been proposed.

Such discrepancy in color occurs due to the discrepancy in rotational axes and/or in the circularity of the photosensitive drum and/or transfer drum, i.e., a distance between respective points on the surface of the photosensitive drum and the rotational axis thereof or a distance between respective points on the surface of the transfer drum and the rotational axis thereof is not constant. That is to say, if peripheral speeds are different at any plural points on the outer surface of the photosensitive drum or the transfer drum, the discrepancy in the different color images will occur.

Accordingly, in conventional color electrophotographic equipment, when a driving force is transmitted from the gear on the flange of the photosensitive drum to the transfer drum there occurs the limitation in that the outer diameter of the transfer drum must be greater, by an integral number of times, than that of the photosensitive drum, or the high accurate circularity and coaxiality of a pitch circle of the flange gear is required.

For example, if the pitch circle of the flange gear deviates from circularity by a, an amount of deviation or discrepancy on the peripheral surface of the transfer drum will be as follows:

$$\text{Amount of discrepancy} \approx (a^2/4r)\sin(\omega t - \phi)\cos(\omega t - \phi) + a \cdot \sin(\omega t - \phi) - (a^2/4r)\sin\omega t \cdot \cos\omega t - a \cdot \sin\omega t.$$

Where, r is a radius of the photosensitive drum ($r >> a$), $\phi$ is a phase difference of the photosensitive drum (due to the difference in diameter between the transfer drum and the photosensitive drum) caused when the transfer drum is rotated by one revolution.

The amount of discrepancy becomes maximum when the phase difference is $\pi$ ($\phi = \pi$), for example, which corresponds to the fact that a ratio between the diameter of the transfer drum and that of the photosensitive drum is 3:2. In this case, the maximum amount of discrepancy becomes $2a$. Thus, to limit the discrepancy in color due to the noncoaxiality within 50 $\mu$m, high accurate coaxiality within a range of 25 $\mu$m or less is required. Further, when the photosensitive drum and the transfer drum are driven independently, two or more motors are required, thus leading to a cost increase.

SUMMARY OF THE INVENTION

An object of the present invention is to provide an image forming system which can form an image with high quality and without any discrepancy in color.

Another object of the present invention is to provide an image forming system wherein a discrepancy in color does not occur even when a ratio between an outer diameter of a transfer sheet bearing member and that of an image bearing member is not an integral number.

A further object of the present invention is to provide an image forming system which eliminates a drawback generated when a peripheral speed of an image bearing member or a transfer sheet bearing member at various points on a peripheral surface of the member very.

The other objects and features of the present invention will be apparent from the following detailed explanation.

DETAILED DESCRIPTION OF THE PREFERRED EMBODIMENTS

The present invention will now be explained in connection with embodiments thereof with reference to the accompanying drawings.

Figure 2:
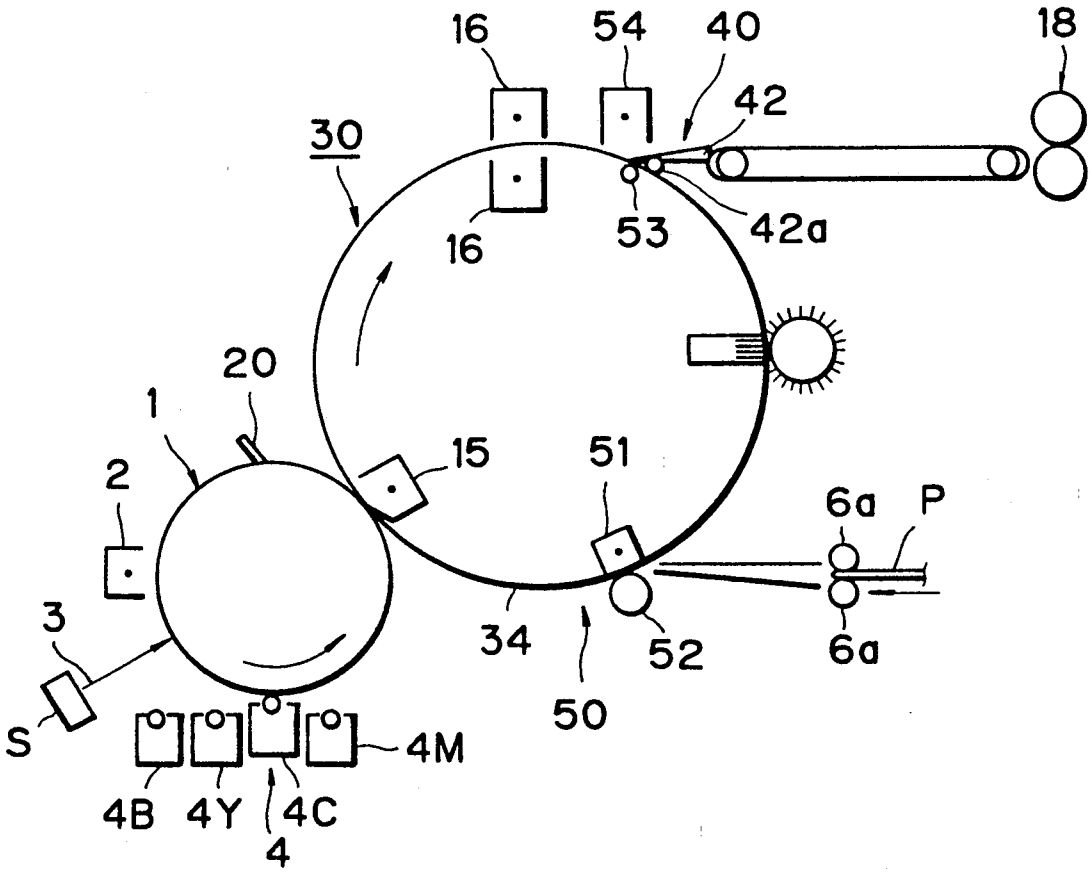
FIG. 2 is a schematic constructural view of an image forming system according to a preferred embodiment of the present invention.

FIG. 2 is an elevational sectional view of a color electrophotographic machine as an example of an image forming system of the present invention. An electrophotographic photosensitive drum 1 acting as an image bearing member is rotatably supported, and an image forming means is disposed around the drum to form a toner image on the photosensitive drum.

More particularly, the rotating photosensitive drum 1 is uniformly charged by a primary charger 2, and a light image 3 from an exposure means S comprising a laser beam writing means such as a laser scanner is illuminated onto the photosensitive drum in response to image information, thereby forming an electrostatic latent image on the photosensitive drum 1. The electrostatic latent image is visualized as a toner image on the photosensitive drum 1, for example by a shiftable developing means 4.

The shiftable developing means 4 comprises four developing devices 4M, 4C, 4Y, 4B each containing magenta color developer, cyan color developer, yellow color developer and black color developer, respectively, and a guide (not shown) for holding these four developing devices and shiftable in a horizontal direction. The shiftable developing means 4 permits a desired developing device to be moved to a position facing an outer surface of the photosensitive drum 1, thereby developing the electrostatic latent image on the photosensitive drum 1.

The visualized image or toner image formed on the photosensitive drum is transferred on a transfer sheet P which is carried by a transfer means 30 (described later) and conveyed in a direction shown by the arrow by transfer means and then is abutted against the photosensitive drum 1.

The residual toner remaining on the photosensitive drum 1 is removed by a cleaning device 20, so that the photosensitive drum can be used again for the next color image forming process.

In this way, when the plural color image is formed by the color electrophotographic machine, a transfer drum formed by winding a high resistive film (transfer film) around a drum-shaped frame is used as the transfer means 30 to establish a multitransfer system. That is to say, the toner images for respective colors are formed on the photosensitive drum by the developing devices, and the toner images are successively transferred and superimposed on the transfer sheet carried by the transfer drum 30 at a transfer station. As shown in FIG. 2, there are disposed means 50 (adsorption charger 51 and conductive roller 52) for applying charges to a transfer film 34 arranged around the peripheral surface of the transfer drum and the transfer sheet P, thereby electrostatically adhering the transfer sheet to the transfer film 34 to convey the sheet.

In this case, the adsorption charger 51 applies a charge having a polarity opposite to that of the toner image to an inner surface of the transfer film 34, and the conductive roller 52 disposed on an outer surface of the transfer film 34 applies a charge having a polarity opposite to that of the adsorption charger 51 to the transfer sheet, since the conductive roller 52 is grounded and acts as a counter electrode for the adsorption charger 51. In the illustrated embodiment, two transfer sheets P can be simultaneously adhered and held on the peripheral surface of the transfer drum along a transfer drum rotating direction. The transfer sheet is electrostatically adhered to the transfer film 34 and is conveyed to the transfer station. Then, the toner image on the photosensitive drum 1 is transferred onto the transfer sheet.

Figure 12:
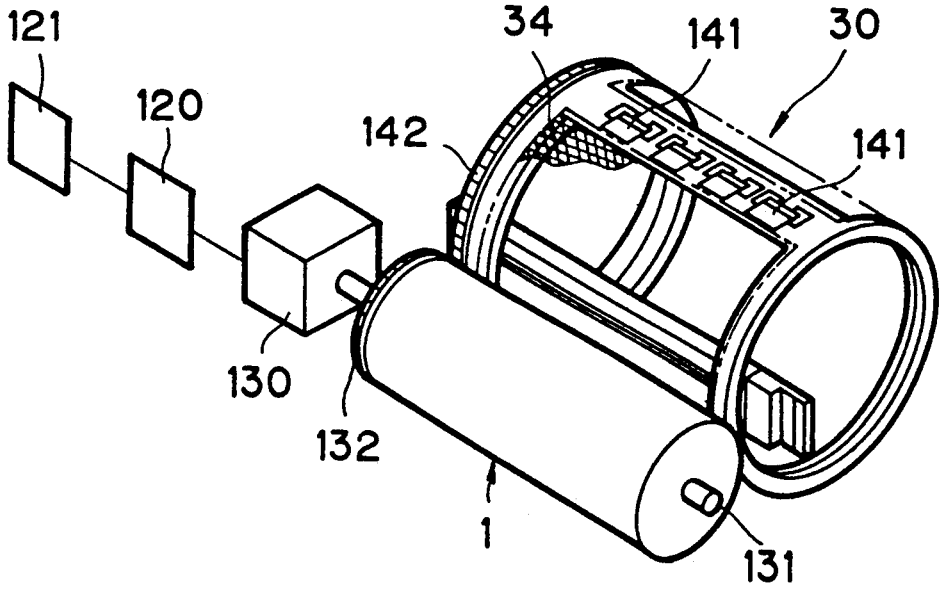
FIG. 12 is a perspective view for explaining a driving mechanism for a photosensitive drum and a transfer drum.

In order to hold the transfer sheet on the transfer drum 30, as shown in FIG. 12, a plurality of grippers 141 may be provided on a portion of the peripheral surface of the transfer drum 30.

Next, a drive mechanism for rotatingly driving the photosensitive drum 1 and the transfer drum 30 will be explained.

Figure 1:
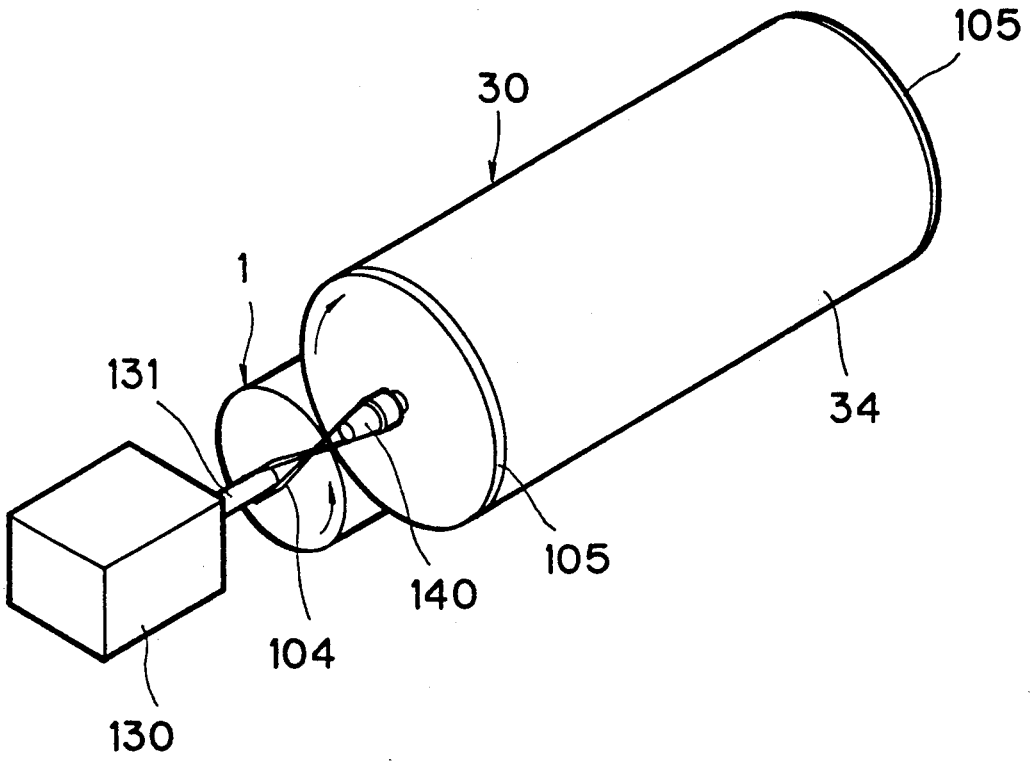
FIG. 1 is a perspective view of a photosensitive drum and a transfer drum of an image forming system according to the present invention.

FIG. 1 shows the photosensitive drum 1 and the transfer drum 30 of the color electrophotographic machine of FIG. 2. The photosensitive drum 1 is rotatably supported on a drum shaft 131 and is rotated in a direction shown by the arrow at a constant angular velocity by a drum drive motor 130. On the other hand, the transfer drum 30 is supported on a transfer drum shaft 140 and is rotated at a constant angular velocity in a direction shown by the arrow by a belt 104 to which a rotation force of the drum shaft 131 is transmitted. In this way, the photosensitive drum 1 and the transfer drum 30 are directly or indirectly driven by the motor 130 acting as a common drive source. Alternatively, the motor 130 may be connected to the transfer drum shaft 140.

Further, abutment rollers 105 are arranged on both ends of the transfer drum 30. The abutment rollers are abutted against the photosensitive drum 1 so that a predetermined clearance or gap, for example, of 0.1 mm is created between the transfer film 34 of the transfer drum 30 and the photosensitive drum 1.

More particularly, the abutment rollers 105 are rotatably mounted on the transfer drum shaft 140, with the result that, even if the line speed of the photosensitive drum is different from that of the transfer drum at the nearest point due to the lack of circularity of the transfer drum 30 and/or the photosensitive drum 1, or the lack of coaxiality between these drums, the angular velocities of these drums become the same, because the driving force from the surface of the photosensitive drum 1 is not transmitted to the surface of the transfer drum 30 and the transfer drum shaft 140 via the rollers 105. Incidentally, the abutment rollers 105 may be supported on the drum shaft 131.

Next, an example of the transfer drum 30 used with the color electrophotographic machine according to the illustrated embodiment will be explained with reference to FIGS. 3 to 6.

In this embodiment, the transfer means or transfer drum 30 includes cylindrical end rings 31, 32 and a connecting portion 33 for interconnecting these rings 31, 32. The cylindrical end rings 31, 32 and the connecting portion 33 constitute a drum frame around which the transfer sheet bearing member or transfer film 34 comprising a dielectric film is wound.

A separating means 40 for separating the transfer sheet from the transfer drum 30 is arranged adjacent to the transfer drum 30. The separating means 40 comprises a separating claw supporting member 41 extending along an axial direction of the transfer drum 30, and a plurality of (three in the illustrated embodiment) peeling members or separating claws 42 secured to the supporting member 41. Separating abutment rollers 42*a* are rotatably mounted on each separating claw 42 at a free end portion thereof on both sides, for the purpose described later.

Figure 3:
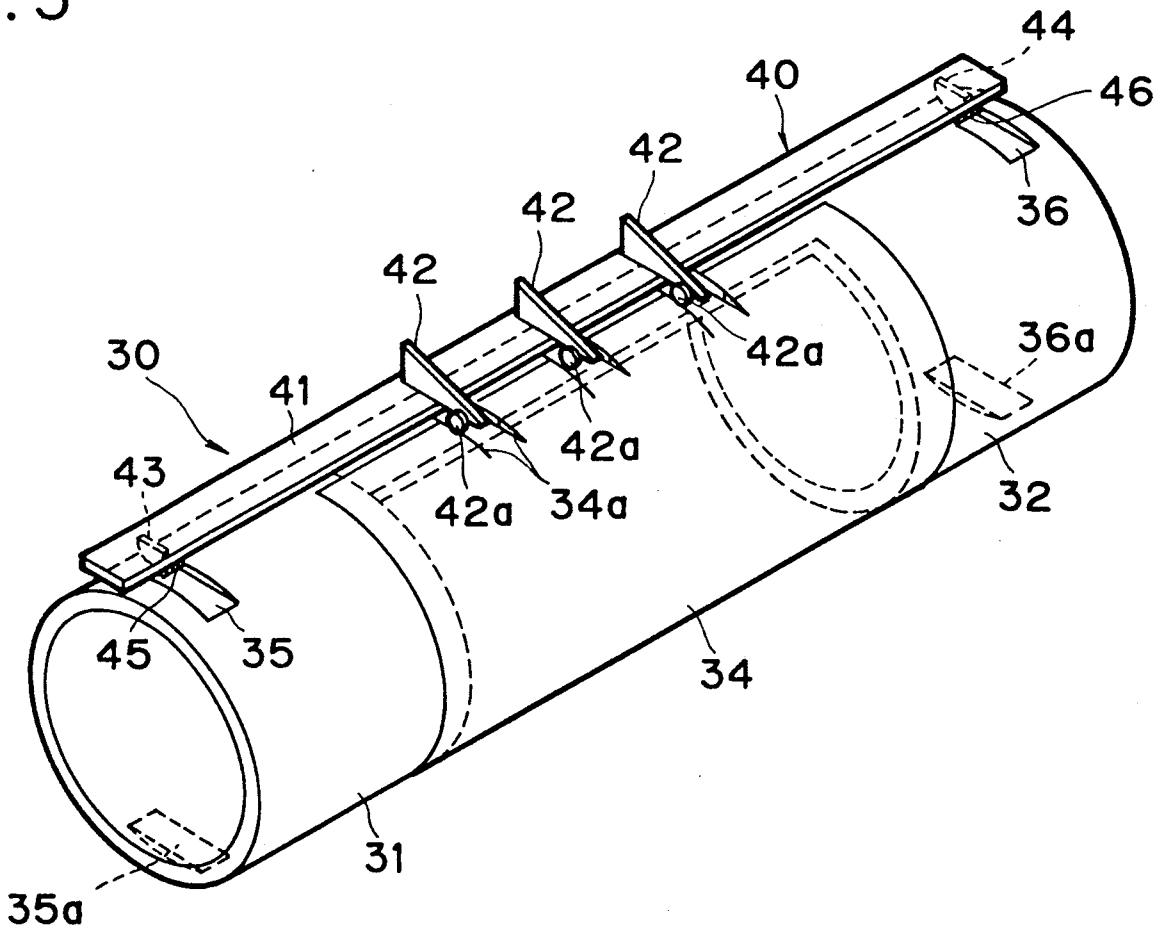
FIG. 3 is a perspective view of a transfer drum according to an embodiment of the present invention.
Figure 4:
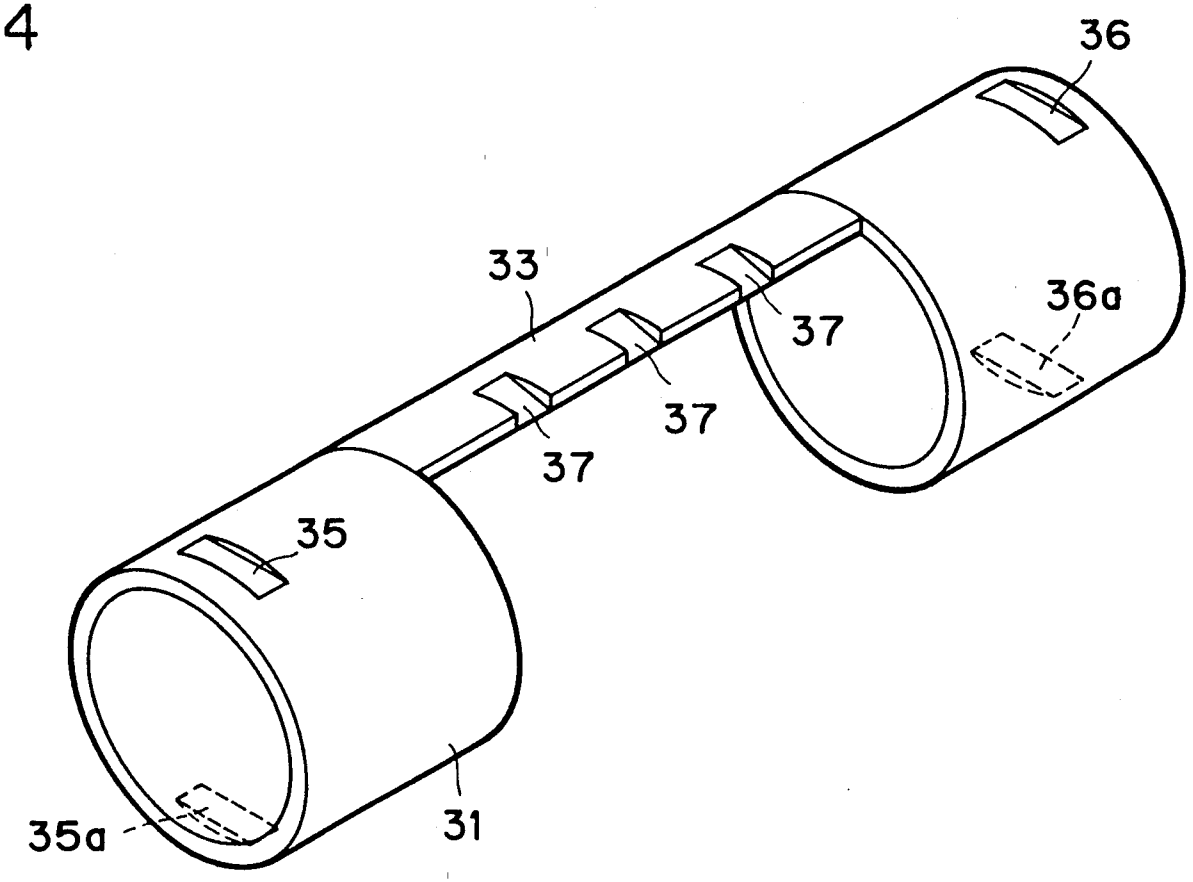
FIG. 4 is a perspective view of a frame of the transfer drum.
Figure 5:
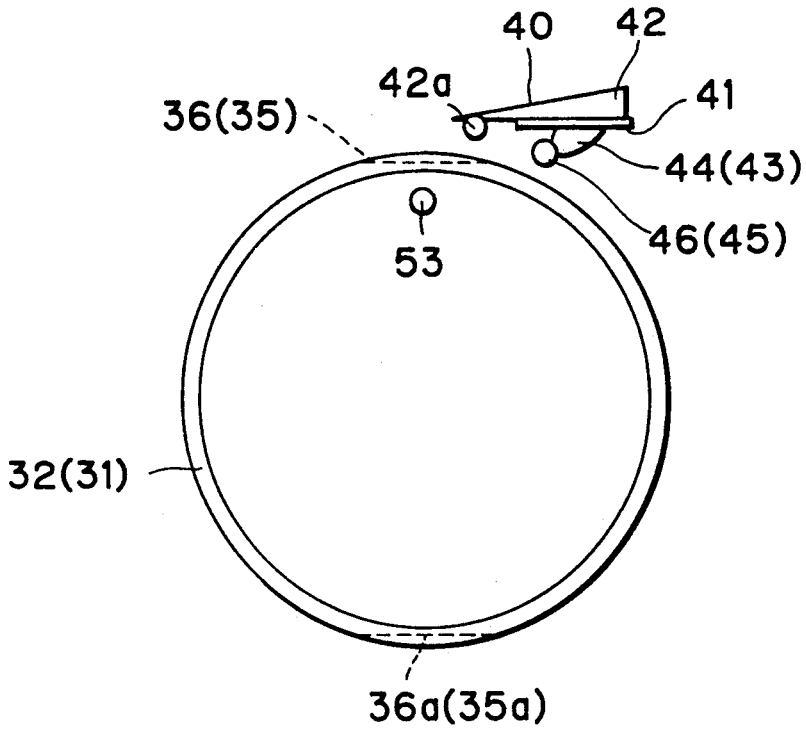
FIG. 5 is a cross-sectional view of the transfer drum.

Further, as can be seen from FIGS. 3 and 5, the supporting member 41 is provided at its both ends with abutment rollers 45, 46 via appropriate support plates 43, 44, respectively. When a separating claw actuating clutch (not shown) is activated, the abutment rollers 45, 46 are abutted against the cylindrical end rings 31, 32 of the transfer drum 30, and are guided by guide grooves 35, 36 formed in the end rings 31, 32 so that the separating claws 42 are rotated downwardly in a direction normal to the transfer drum 30.

Figure 6:
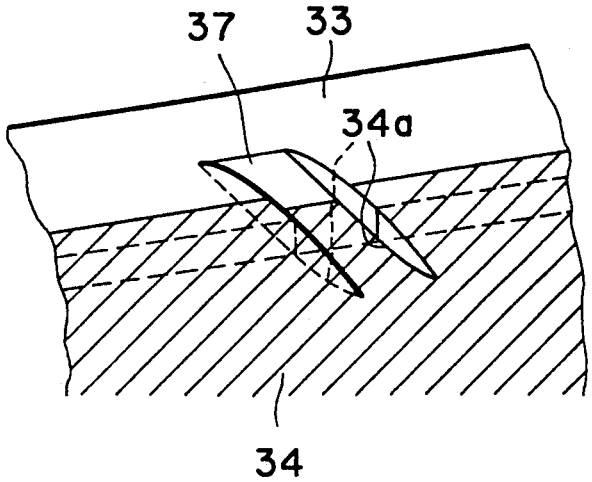
FIG. 6 is a perspective view of a transfer sheet separating notch formed in a connecting portion of the transfer drum.

Notches 37 are formed in the connecting portion 33 so that the separating claws 42 can easily be inserted between the transfer film 34 and the transfer sheet P adhered to the transfer film 34. Further, as shown in FIGS. 3 and 6, a leading edge of the transfer film 34 is provided with cut lines 34*a* along the notches 37 of the connecting portion 33 and is secured to the connecting portion 33 so that a radius of curvature of the transfer film 34 becomes greater locally (as shown by a hatched area in FIG. 6) than the other.

The transfer sheet P adhered to the transfer drum 30 is conveyed to the transfer station where a transfer charger 15 is disposed. The transfer charger comprises a transfer corona charger 15 for applying a charge having a polarity opposite to that of the toner to the inner surface of the transfer film 34, in order to transfer the first color toner (for example, magenta toner) on the photosensitive drum 1 onto the first transfer sheet P. Before the first transfer sheet reaches the conductive roller 52 again, the charge on the conductive roller 52 is removed and the conductive roller is retracted outwardly to a retard position (for example, spaced apart from the transfer film 34 more than 2 mm) in order not to distort the toner image transferred to the transfer sheet P.

Then, the second color toner image formed on the photosensitive drum 1 in registration with the first transfer sheet to which the first color toner image was transferred is transferred onto the first transfer sheet by the transfer corona charger 15 so that the second toner image is superimposed on the first color toner image, and the second color toner image is transferred onto a second transfer sheet to which the first color toner image was transferred so that the second toner image is superimposed on the first color toner image. In a similar manner, four color toner images are transferred onto the two transfer sheets, respectively.

FIGS. 7A to 7D are views for explaining the displacement between the transferred first color image and the transferred second color image, i.e., the "discrepancy in color" caused when a rotational center 0' (shown by a simbol ·) of the photosensitive drum 1 deviates or is displaced from rotational center 0 (shown by a simbol x) of the rotation shaft 131 of the photosensitive drum 1 by an amount a. Incidentally, in this embodiment, an outer diameter of the photosensitive drum 1 is 120 mm and an outer diameter of the transfer drum is 180 mm (i.e., the latter is greater than the former by 1.5 times).

Now, it is assumed that after the drum 1 is charged, an image having a length of L in a circumferential direction of the photosensitive drum 1 is exposed.

Figure 7A:
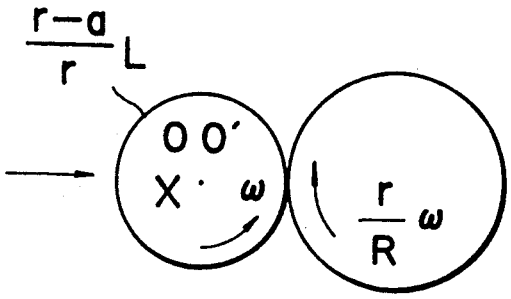
FIGS. 7A to 7D are views for explaining a discrepancy in image.

FIG. 7A shows a condition wherein a line velocity of a drum portion exposed in the formation of the latent image for the first color becomes minimum. When the angular velocity of the drum shaft 131 is $\omega$ and a radius of the photosensitive drum is r, the latent image having a length of $(r-a)L/r$ is formed on the photosensitive drum. When a radius of the transfer drum is R, the angular velocity of the transfer drum is $r\omega/R$.

Figure 7B:
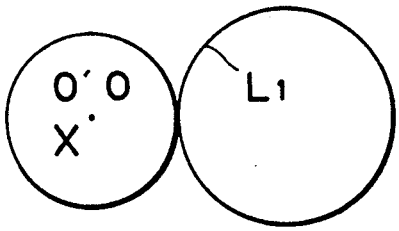

FIG. 7B shows a condition that, after the latent image of FIG. 7A is developed to form the toner image, it is transferred onto the transfer drum. A time t required for transferring the toner image having the length of $\{(r-a)L/r\}$ becomes $L/(r\omega)$ from a relation $(r-a)L/r=(r-a)\omega t$. Since the line velocity Vt of the surface of the transfer drum is $R\cdot r\omega/R$ $(=r\omega)$, a length $L_1$ of the transfer image becomes $Vt\cdot t(=L)$.

Figure 7C:
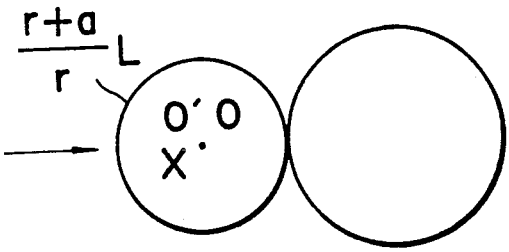

FIG. 7C shows a condition wherein a latent image for the second color is formed. In this embodiment, since the diameter of the photosensitive drum is 120 mm and the diameter of the transfer drum is 180 mm, the line velocity of the drum portion exposed in the formation of the latent image becomes maximum. That is to say, the line velocity is $(r+a)\omega$. The latent image having a length of $(r+a)L/r$ is formed on the photosensitive drum.

Figure 7D:
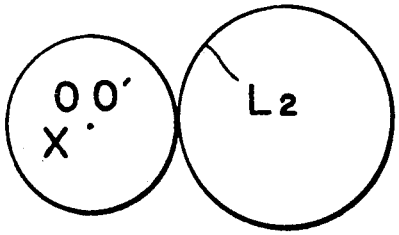

FIG. 7D shows a condition that, after the latent image of FIG. 7C is developed to form the toner image, the toner image is transferred onto the transfer drum. A time t required for transferring the toner image having the length of $\{(r+a)L/r\}$ becomes $L/r\omega$ from a relation $(r+a)L/r=(r+a)\omega t$. Similar to FIG. 7B, a length $L_2$ of the transferred image becomes L.

In this way, the relation between the length of the transferred first color image and that of the transferred second color image becomes $L_1=L_2=L$, thus not causing a discrepancy in color. Also, in the case where the circularity of the photosensitive drum 1 is uneven, a discrepancy in color does not occur for the same reason as above. The circularity of the transfer drum does not relate to the discrepancy in color. The third and fourth color images can be transferred onto the transfer drum through a similar image forming process, thus superimposing the images without causing the discrepancy in color.

A pair of AC corona dischargers 16 are disposed with the interposition of the transfer film 34 to weaken the adsorption forms for adhering the transfer sheet to the transfer film 34 after the transferring operation is finished, thereby removing the charges from the transfer sheet P and the transfer film 34.

In order to separate the first transfer sheet P from the transfer film 34, as seen from FIGS. 3 to 6, the abutment rollers 45, 46 of the separating means 40 are driven by the separating claw actuating clutch (not shown) to be urged against the cylindrical and rings 31, 32, and are guided by the guide grooves 35, 36 formed in the end rings 31, 32. As a result, the free ends of the separating claws 42 are rotated downwardly toward the transfer film 34 in the direction normal to the transfer drum 30.

Further, the separating abutment rollers 42*a* are shifted along the notches 37 of the connecting portion 33, with the result that the separating claws 42 are inserted between the leading edge of the transfer sheet and the transfer film 34 at a position where the radius of curvature of the transfer film 34 is changed locally or at a position where the transfer film 34 is deformed by pushing it up by a push-up member 54, thereby separating the transfer sheet P from the transfer film 34. Incidentally, in the separation of the transfer sheet P, in order to prevent the distortion of the image due to the separation discharge caused by separating the transfer sheet P from the transfer film 34, it is preferable to provide a corona discharger 54 to effect the AC corona discharge. After the transferring operation and the sheet separating operation, the transfer sheet P is fed to a fixing device 18, where the toner images are thermally mixed and fixed to the sheet. Thereafter, the transfer sheet is ejected out of the machine. In this way, the image formation process is finished.

Figure 8:
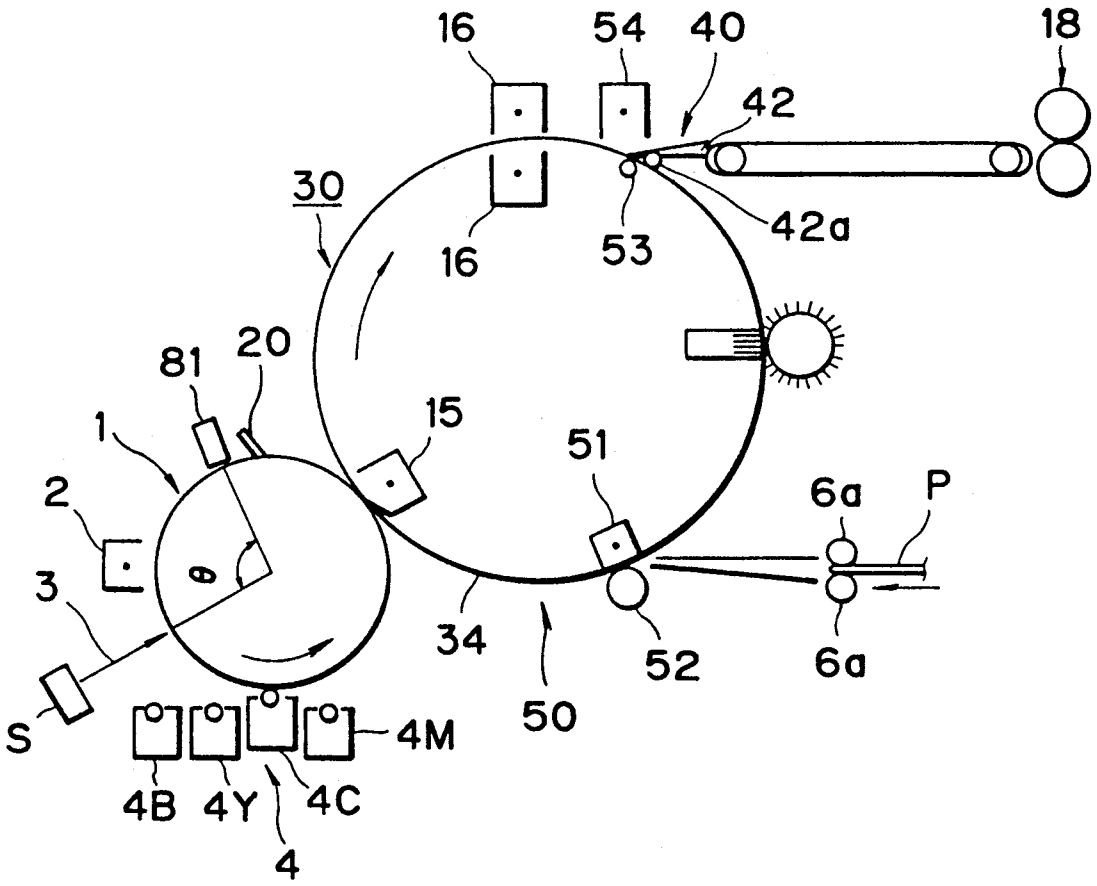
FIG. 8 is a schematic constructural view of an image forming system according to another embodiment of the present invention.

FIG. 8 shows a color electrophotographic machine according to another embodiment of the present invention. Incidentally, the same constructural elements as those in FIG. 2 are designated by the same reference numerals, and the constructural and functional explanation thereof will be omitted.

In this embodiment, unlike the aforementioned embodiment, the driving mechanism for the photosensitive drum 1 and the transfer drum 30 comprises, as shown in FIG. 12, a gear 132 formed on the peripheral surface of the photosensitive drum 1 at its one end, and a gear 142 formed on the peripheral surface of the transfer drum 30 at its one end, which gears are meshed with each other. By rotating the photosensitive drum 1 by a drive motor 130, the driving force is transmitted to the transfer drum 30 via the gears. Also in this embodiment, the outer diameter of the photosensitive drum 1 is 120 mm and the outer diameter of the transfer drum 30 is 180 mm. Further, in this case, the peripheral speed of the photosensitive drum and that of the transfer drum are selected to be the same at the nearest point.

Further, in this embodiment, there is provided a discrepancy detection means 81 for determining the discrepancy in the coaxiality and the circularity of the surface of the photosensitive drum by detecting a distance between the surface of the photosensitive drum and the detection means, and for converting the detected amount of discrepancy into a voltage output. The detection means 81 detects substantially a distance between the center of the photosensitive drum and the surface of such drum. Incidentally, the detection means 81 may be arranged in confronting relation to the surface of the transfer drum so that the discrepancy in the coaxiality and the circularity of the surface of the transfer drum can be determined.

Figure 9:
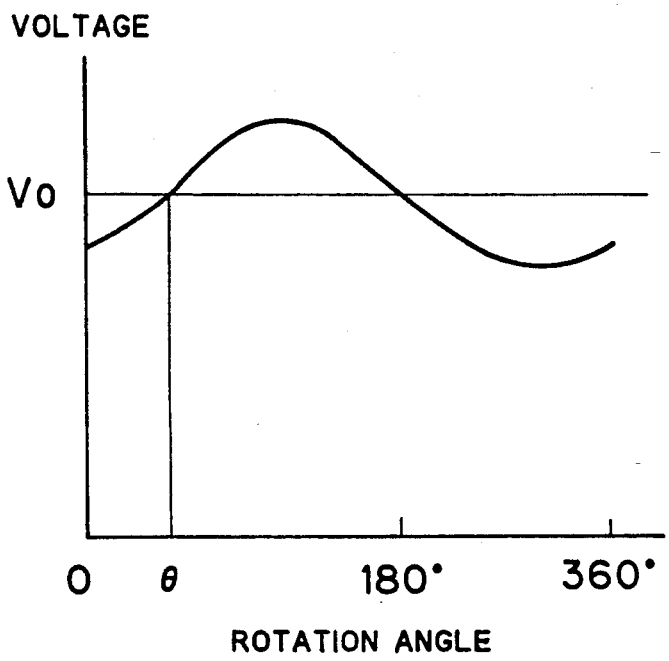
FIG. 9 is a graph showing a detection signal detected by a detection means.

FIG. 9 shows an example of a voltage wave detected by the detection means 81 when the discrepancy in the coaxiality and the circularity of the surface of the photosensitive drum is detected while rotating the photosensitive drum, for example, before the copying operation. In this embodiment, there is no discrepancy in the coaxiality and the circularity of the surface of the photosensitive drum when the surface of the drum is spaced apart from the center of the drum by 60 mm, and this condition corresponds to the voltage value of Vo in FIG. 9. When the voltage is greater than Vo, the surface of the drum is spaced apart from the drum center by more than 60 mm.

Although the detection means 81 may be arranged at any position along the circumference of the photosensitive drum 1, in this embodiment, as shown in FIG. 8, the detection means is arranged at an upstream side of the exposure station by an angle of $\theta$.

Figure 10:
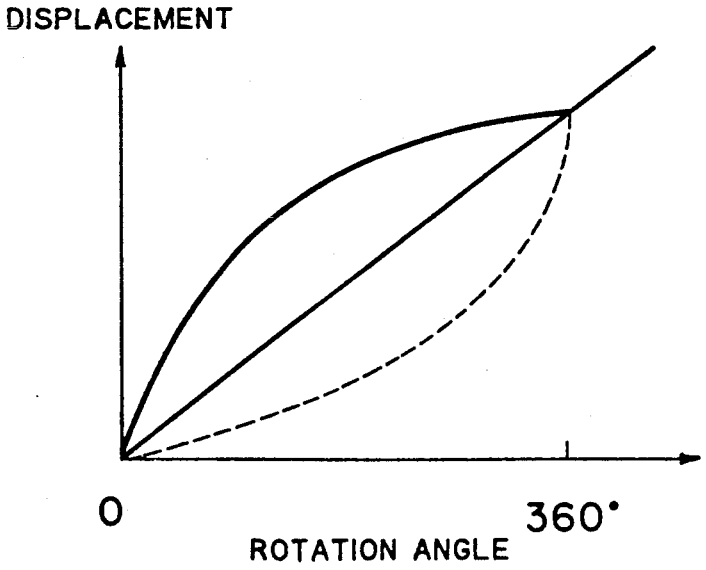
FIG. 10 is a graph showing a relation between the detection signal and displacement.
Figure 11:
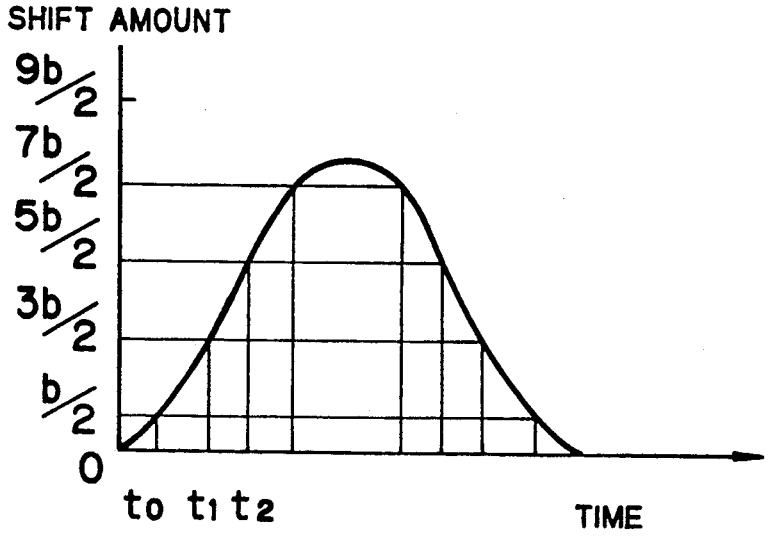
FIG. 11 is a graph showing a relation between the detection signal and shift amount.

As shown by the solid line in FIG. 10, the extension and contraction of the image for the first color caused by the exposure has a wave obtained by integrating the voltage wave with a deviation of $\theta$. The position direction shows the extension of the image. The broken line shows the extension and contraction of the image for the second color caused by the exposure. A distance between the solid line and the broken line corresponds to the amount of the discrepancy in color. FIG. 11 shows the difference between the solid line and the broken line. In the case where a laser beam repeating the main scanning and the auxiliary scanning is used as the exposure means 3, an extension of the image can be effected by writing the same information in the circumferential direction of a photosensitive drum and the contraction of the image can be effected by thinning the information.

Further, when a discrepancy in color is corrected, the image may be partially expanded or contracted. That is to say, when the image for the second color is written, the time when the difference between the second color and the first color becomes more than ½ pixel is previously determined or the number of lines from the start of the writing is previously determined, and, if the second color is extended, then the line information is thinned, and if the second color is contracted, then the same information is repeatedly written again.

In the time tn when the difference in FIG. 11 becomes $b/2+n \times b$ (n is an integral number), if the polarity of the derivative value of the wave is positive, then the line information of the second color is written repeatedly, whereas, if the polarity is negative, the line information is thinned. The discrepancy in color between then the first color and the second color is b/2 at the maximum.

Similarly, regarding the third and fourth colors, since the phase difference between the photosensitive drum and the transfer drum is 180° in this embodiment, the third color may be written in the same order as the first color and the fourth color may be written in the same order as the second color.

Thereafter, the color image forming process is effected in the same manner as the previous embodiment shown in FIG. 2.

In this embodiment, when the cleaning device 20 uses a so-called cleaning elastic blade urged against the photosensitive drum 1 at a given position, the load affecting the rotation of the photosensitive drum is varied in accordance with the discrepancy in the coaxiality and circularity of the surface of the photosensitive drum. Accordingly, in place of the detection means 81, as shown in FIG. 12, a detection means 120 may be provided to detect the current value or voltage value flowing in the drive motor 130 varied in accordance with the variation of the load, and the detected value may be sent to a CPU 121. That is to say, the detection means 120 detects substantially the distance between the center of the photosensitive drum and the surface of the drum. Incidentally, the motor 130 and the detection means 120 may be the transfer drum shaft.

The CPU 121 treats the detection signal to control the laser exposure means in the same manner as mentioned above, thus preventing any discrepancy in color.

As mentioned above, in the image forming system according to the present invention, since the image bearing member such as the photosensitive drum and the transfer sheet bearing member such as the transfer drum are driven by the single motor, and the image bearing member and the transfer sheet bearing member are designed so that the angular velocity of the transfer sheet bearing member is not varied even if the peripheral speed of the surface of the image bearing member varies, it is possible to obtain an image with high quality without any discrepancy in color even when the ratio between the outer diameters of the transfer drum and of the photosensitive drum is not an integral number.

What is claimed is:

1. An image forming apparatus, comprising:

a rotatable image bearing member rotated at a constant angular velocity;

image forming means for forming an image on said image bearing member;

a rotatable transfer sheet bearing member rotated at a constant angular velocity for bearing a transfer sheet;

a common drive source for rotatably driving said image bearing member and said transfer sheet bearing member;

transfer means for sequentially transferring and superimposing a plurality of images on said image bearing member onto a transfer sheet born by said transfer sheet bearing member;

spacing means for maintaining a predetermined gap between a surface of said image bearing member and a surface of said sheet bearing member, wherein transmission of a drive force between the surface of said image bearing member and the surface of said transfer sheet bearing member is substantially prevented.

2. An image forming apparatus according to claim 1, further comprising a rotary shaft for rotatably supporting said image bearing member and a rotary shaft for rotatably supporting said transfer sheet bearing member.

3. An image forming apparatus according to claim 2, further comprising transmission means for transmitting a driving force from said rotary shaft of said image bearing member to said rotary shaft of said transfer sheet bearing member substantially without imparting a driving force from a surface of said image bearing member to a surface of said transfer sheet bearing member.

4. An image forming apparatus according to claim 1, wherein said spacing means comprises a rotary member rotatable relative to a rotary shaft of said image bearing member or a rotatable shaft of said transfer sheet bearing member.

5. An image forming apparatus according to claim 1, wherein said image forming means forms a toner image on said image bearing member, and said toner image is transferred onto the transfer sheet by said transfer means.

6. An image forming apparatus according to claim 5, wherein a plurality of toner images can be formed on said image bearing member, said toner images being successively transferred onto the same transfer sheet born by said transfer sheet bearing means in a superimposed fashion.

7. An image forming apparatus according to claim 6, wherein the image forming apparatus can form a full-color image on the transfer sheet.

8. An image forming apparatus according to claim 1, wherein neither a ratio of the diameter of said image bearing member to a diameter of said transfer sheet bearing member nor a ratio of the diameter of said transfer sheet bearing member to the diameter of said image bearing member is an integer value.

9. An image forming apparatus, comprising:

a rotatable image bearing member;

image forming means for forming an image on said image bearing member;

a rotatable transfer sheet bearing member for bearing a transfer sheet;

a common drive source for rotatably driving said image bearing member and said transfer sheet bearing member;

transfer means for transferring an image on said image bearing member onto the transfer sheet born by said transfer sheet bearing member;

detection means for detecting a distance between a surface of said image bearing member and a center of said image bearing member; and control means for controlling an image forming condition of said image bearing member on the basis of a detection signal from said detection means.

10. An image forming apparatus according to claim 9, wherein said control means controls the image forming condition in a rotating direction of said image bearing member on the basis of said detection signal.

11. An image forming apparatus according to claim 9, wherein said image forming means includes latent image forming means for forming a latent image on said image bearing member in response to image information, and said latent image forming means repeats or deletes a portion of the main scan of said image information in the rotating direction of said image bearing member on the basis of said detection signal.

12. An image forming apparatus according to claim 11, wherein said latent image forming means comprises a laser scanner emitting a laser beam.

13. An image forming apparatus according to claim 9, wherein said image forming means forms a toner image on said image bearing member, and said toner image is transferred onto the transfer sheet by said transfer means.

14. An image forming system according to claim 13, wherein a plurality of toner images can be formed on said image bearing member, said toner images being successively transferred onto the same transfer sheet born by said transfer sheet bearing means in a superimposed fashion.

15. An image forming apparatus according to claim 14, wherein the image forming apparatus can form a full-color image on the transfer sheet.

16. An image forming apparatus according to claim 9, wherein said detection means detects a position of a surface of said image bearing member.

17. An image forming according to claim 16, wherein said detection means detects a distance between the surface of said image bearing member and said detection means.

18. An image forming apparatus according to claim 9, wherein said detection means detects a load on a shaft of said image bearing member.

19. An image forming apparatus according to claim 8, wherein neither a ratio of the diameter of said image bearing member to a diameter of said transfer sheet bearing member nor a ratio of the diameter of said transfer sheet bearing member to the diameter of said image bearing member is an integer value.

* * * * *

UNITED STATES PATENT AND TRADEMARK OFFICE

CERTIFICATE OF CORRECTION

PATENT NO. 5,319,423

DATED June 7, 1994

INVENTOR(S) TAKEDA ET AL.

It is certified that error appears in the above-indentified patent and that said Letters Patent is hereby corrected as shown below: On title page, item

[56] References Cited

"4,088,481 8/1978 Ayash" should read
--4,088,481 5/1978 Ayash--.

Column 1

Line 16, "of" should read --or--.

Column 2

Line 3, "the" (second occurrence) should read --a--.
Line 8, "drum" should read --drum,--; and "the" (second occurrence) should read --a--.
Line 19, "discrepancy ≈" should read --discrepancy ≃.
Line 54, "very." should read --vary.--

Column 5

Line 55, "retard" should read --retracted--.

Column 6

Line 8, "from" should read --from a--.
Line 61, "the" (second occurrence) should read --a--

Column 7

Line 5, "and rings" should read --end rings--.

UNITED STATES PATENT AND TRADEMARK OFFICE

CERTIFICATE OF CORRECTION

PATENT NO. 5,319,423

DATED June 7, 1994

INVENTOR(S) TAKEDA ET AL.

It is certified that error appears in the above-indentified patent and that said Letters Patent is hereby corrected as shown below:

Column 8

Line 29, "a" should read --the--; and "the" should read --a--.

Line 46, "the" (second occurrence) should read --then the--.

Line 48, "then" should be deleted.

Column 9

Line 14, "the" (first occurrence) should read --a--.

Column 10

Line 54, "system" should read --apparatus--.

Line 67, "forming" should read --forming apparatus--.

Column 11

Line 6, "claim 8," should read --claim 9,--.

Signed and Sealed this

Twenty-ninth Day of November, 1994

*Attest:*

Bruce Lehman

BRUCE LEHMAN

*Attesting Officer*

*Commissioner of Patents and Trademarks*